United States Patent [19]

Bollani

[11] 4,456,502

[45] Jun. 26, 1984

[54] METHOD FOR ADJUSTING THE FORMAT OF CONTINUOUS AQUEOUS FIBRE SUSPENSION DELIVERED BY THE HEAD BOXES OF A PAPER MANUFACTURING MACHINE, AND THE DEVICE FOR CARRYING OUT SAID METHOD

[75] Inventor: Umberto F. Bollani, Turin, Italy

[73] Assignee: Beloit Corporation, Beloit, Wis.

[21] Appl. No.: 401,739

[22] Filed: Jul. 26, 1982

[30] Foreign Application Priority Data

Jul. 31, 1981 [IT] Italy ..... 68078 A/81

[51] Int. Cl.[3] ..... D21F 1/56

[52] U.S. Cl. ..... 162/133; 162/191; 162/194; 162/195; 162/264; 162/286; 162/353

[58] Field of Search ..... 162/191, 194, 264, 286, 162/304, 133, 195, 353, 334

[56] References Cited

U.S. PATENT DOCUMENTS

| | | | |
|---|---|---|---|
| 1,734,929 | 11/1929 | Vedder | 162/353 |
| 3,361,620 | 1/1968 | Gedemer | 162/309 |
| 4,207,144 | 6/1980 | Meinecke et al. | 162/304 |

*Primary Examiner*—William F. Smith

*Attorney, Agent, or Firm*—Hill, Van Santen, Steadman & Simpson

[57] ABSTRACT

A method and mechamism of removing an edge of a paper web formed on a traveling foraminous wire from stock issuing from the slice of a headbox including a blade positioned parallel to the machine direction and located to separate the edge from the flow of stock issuing from the slice opening before it engages the traveling wire and collecting the edge material separated and conveying it away so that the material can be used.

8 Claims, 4 Drawing Figures

METHOD FOR ADJUSTING THE FORMAT OF CONTINUOUS AQUEOUS FIBRE SUSPENSION DELIVERED BY THE HEAD BOXES OF A PAPER MANUFACTURING MACHINE, AND THE DEVICE FOR CARRYING OUT SAID METHOD

BACKGROUND OF THE INVENTION

The present invention relates to improvements in papermaking machines, and more particularly to a method and device for separating the marginal edge of a paper web formed on a traveling wire wherein the web is single layer or multiple layered.

In a papermaking machine, the sheet or web is formed by depositing one or more layers of stock which is fibers in an aqueous suspension onto a traveling wire. The stock is normally derived from wood or other vegetable fibers, and the suspension of stock is delivered onto the traveling wire by headboxes having slice openings and positioned along the wire. The layers of stock which are formed in this manner have longitudinal edges which are not perfectly even or regular, both from the standpoint of their geometry and their dimension, and these edges must therefore be made even and regular after the headboxes have deposited the web on the wire. This is frequently done by means of devices which employ water jets which are directed onto the edges of the layers on the wire in order to separate the most irregular marginal portions from the web. The scrap which is generated by this separation arrangement is collected by ducts, and the material of the scrap is used for additional stock.

Methods and devices used heretofore for trimming or forming the edge of a traveling web have encountered disadvantages. First, they do not allow complete and useful recovery of the scrap material which is derived from the separated edge. This is because the usual edge forming device which is located a considerable distance downstream of the headbox separates the marginal portions of the single layer or the multi-layered web in a single operation, and when multiple layers are used, each of the layers normally comprises fibers of a different type and quality. That is, where multiple layer paper is made, one layer may be made of fibers that has unique tear strength, and another layer made of fibers has unique softness. If the edge from the multiple layers is separated, this mixes the fibers so that they cannot be used to make either layer. It is almost impossible to separate the fibers of the various layers after they have been intermixed and their subsequent use is considerably limited.

Accordingly, an object of the invention is to provide a method and a mechanism for adjusting and trimming the edge of one or more continuous layers of paper delivered by headboxes, and which enables the marginal portions of the edges of these layers to be separated while at the same time making it possible to completely reuse the fibers of the scrap stock separated from the edge of the web.

A further object of the invention is to provide a device for trimming the edge of a traveling paper web being formed which can be associated with the headbox and provides for separation at an early stage of the formation.

The concepts of the invention provide a method for adjusting the edge of one or more overlying layers of paper web deposited on an endless traveling wire of a papermaking machine wherein each of the layers is delivered through the slice opening of individual headboxes and where a blade separates the marginal portions of each edge of at least one of the layers from the remainder of the layers as it leaves the slice opening, and a stage is provided in which the scrap generated by separating the marginal portions is conveyed into a collector.

The invention also provides a device for adjusting the width or edge of at least one layer of a fibrous web deposited on a traveling wire of a papermaking machine wherein the layer is delivered through the slice of a headbox and the mechanism is characterized by a blade mounted on the headbox and positioned along the emerging stock jet with the blade located in a postion to separate the marginal portion of at least one edge of one layer from the remainder of the layer and conveying means is provided by which the scrap generated by separating the edge is conveyed into a collector.

Other objects, advantages and features of the invention will become more apparent with the teaching of the concepts and principles of the invention in connection with the disclosure of the preferred embodiments thereof, in which:

DESCRIPTION OF THE MECHANISM

Figure 1:
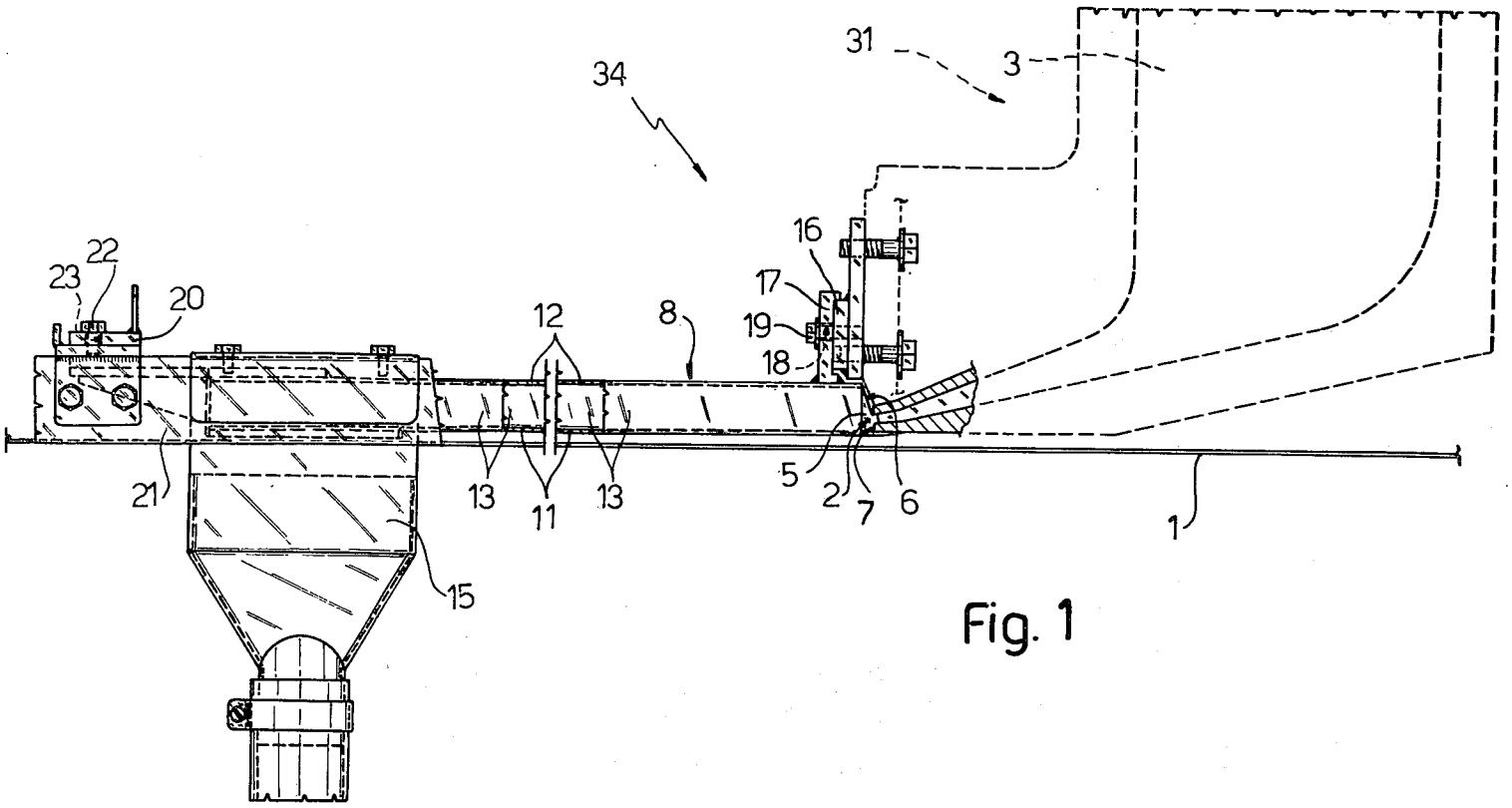
FIG. 1 is a diagrammatic side view of a device constructed and operated in accordance with the principles of the present invention.
Figure 2:
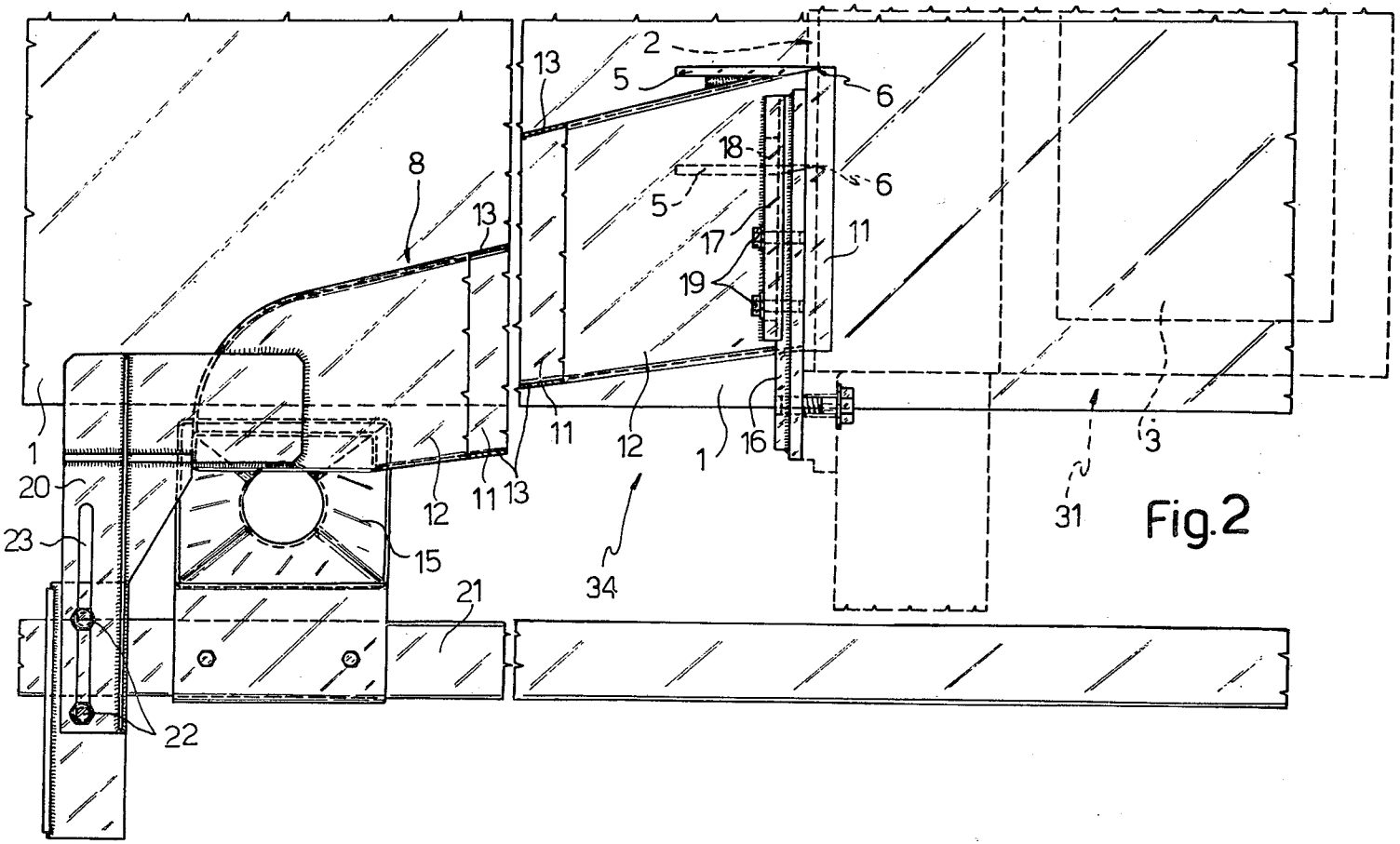
FIG. 2 is a plan view of the mechanism of FIG. 1.
Figure 3:
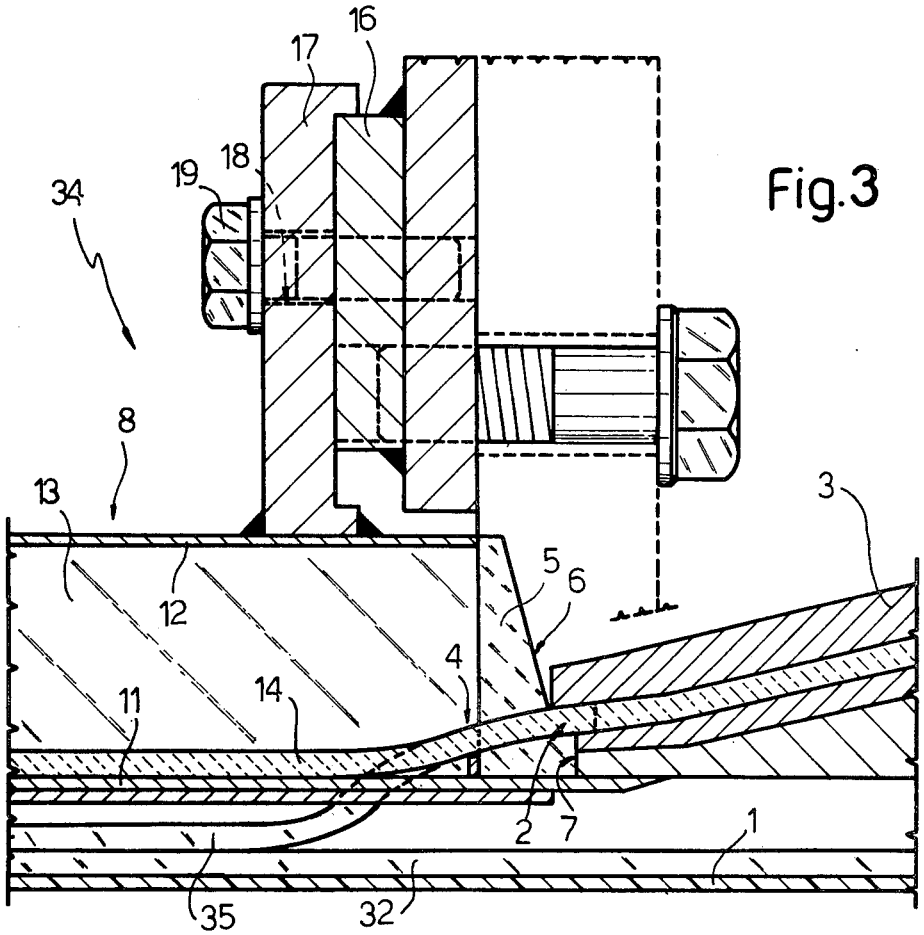
FIG. 3 is a more detailed view of the device of FIG. 1 showing a portion of the mechanism substantially enlarged.

In a continuous paper web manufacturing mechanism, a continuos foraminous wire 1, FIGS. 1 and 2, is provided for forming the web and is positioned to receive one or more layers of stock which is fibers in an aqueous suspension, normally wood fibers. Each layer is delivered through the slice opening 2 of a corresponding headbox 3 to which a suitable quantity of the stock is delivered for continuous flow of stock through the slice opening. The slice opening 2 is positioned above the wire so that the stock leaving the slice opening spouts at a predetermined flow rate and forms a layer 4 of predetermined thickness on the wire, as may be seen in FIG. 3.

The mechanism according to the invention includes at least one flat blade 5 disposed in a plane perpendicular to the plane of the wire and in a plane extending in the machine direction which is also essentially perpendicular to the plane of the layer of stock leaving the slice opening. The blade has a sharp front edge 6 which is configured so that it makes contact with the front edges 7 of the slice opening, FIG. 3, touching both the upper and lower slice lip and the blade may be configured at its leading edge so that it actually projects into the slice opening.

As the layer of stock leaves the slice opening 2, the blade is located in a predetermined position relative to the width of the web so as to be able to separate the marginal edge portion of at least one edge of the layer 4 from the remainder of the web. Two blades 5 will normally be disposed with one on each side of the slice opening 2 in order to separate both lateral marginal portions of the edges of the layer 4 from the remainder of the web.

The mechanism also includes means for conveying the separated marginal portions into suitable containers or to scrap utilization devices. These means can comprise an assembly of walls arranged to define actual conduits indicated overall by 8, FIGS. 1 and 2. These can comprise, for example, upper and side walls 11, 12 and 13 respectively, FIG. 3, which define a conduit of rectangular cross-section with the lower wall receiving the marginal portion 14 of the layer 4 when these are separated from the remainder of the web.

The blade 5 is conveniently fixed to one of the side walls 13 of the conduit as is illustrated.

The conduit formed in this manner can open into a collection hopper 15, FIGS. 1 and 2, arranged to convey the scrap generated as a result of the separation, into a predetermined zone.

The device also comprises means for transversely adjusting the position of the blade in a cross-machine direction in order to adjust the width of the marginal portion of the edge which is separated from the web. These means can comprise a flat guide 16, FIG. 3, fixed to the frame of the headbox 3, and a slide 17 slidable on said guide and to which the assembly of walls 11, 12, 13 and the blade 5 are fixed. The slide 17 can be provided with slots 18 through which the shank of locking capscrews 19 are inserted. In addition, the wall assembly can be connected to a plate 20, FIG. 2, which can be fixed in a predetermined position relatively to a bar 21 by capscrews 22 inserted through slots 23.

Figure 4:
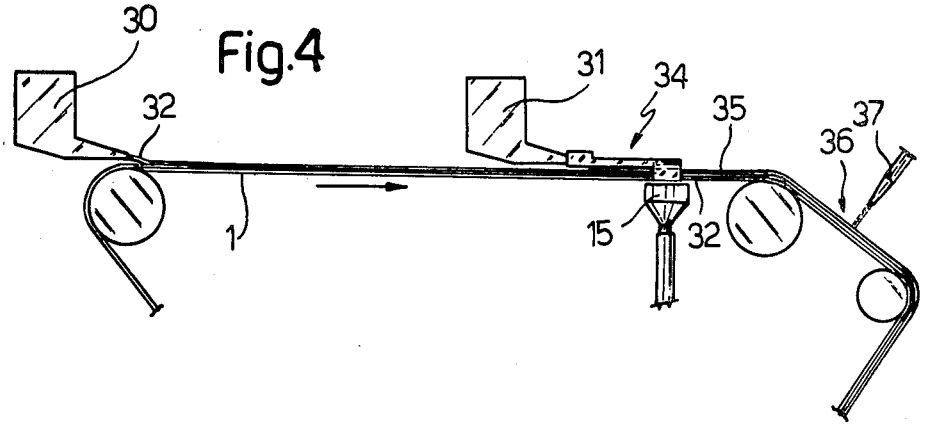
FIG. 4 is a diagrammatic representation of a part of a papermaking machine wherein a multi-layered web is formed and one of the layers is trimmed.

In operation, one or more headboxes, shown as 2 and indicated by the reference numerals 30 and 31, can be disposed along a traveling wire such that, as shown in FIG. 4, there is delivered fiber suspension layers 32 and 35 respectively of which the first is deposited directly on the wire 1, and the second is deposited onto the top of the preceding layer.

According to the concepts of the invention, the edge separating mechanism is located at 34 and is arranged to separate the edge from the second layer. This device is connected to the headbox 31, and a similar device can also be associated with the other headbox 30, or alternately a device may be provided for the headbox 30 and not for the headbox 31. Production lines may be employed comprising more than two headboxes for generating multi-layer sheets and separating mechanisms such as the device 34 associated with one or more of the headboxes.

In the instance of the example illustrated in FIG. 4, the layer 35 is deposited by the headbox 31 on top of the layer 32 which is deposited by the headbox 30. As soon as the layer 35 leaves its slice opening, the edges are separated by the actions of blades 5 of the device 34. The edges are shown as the lateral strips 14, FIG. 3, leaving the main web in the center. The edges comprise irregular marginal portions and the central web has remaining edges which are straight and regular. The removed strips are conveyed through conduits 8 defined by the walls 11, 12 and 13 to a reutilization zone and the web is deposited onto the previously formed layer 32.

The web comprising the two layers formed in this manner can pass through a zone 36 in which suitably directed water jets 37 are directed to separate the marginal portions of the first layer in a conventional manner. Thus, if the two layers are formed of different fibers, the trimmed edges of fibers are maintained separate so that they can be reutilized. The remaining multilayered web has uniform straight edges.

If the first headbox 30 were also provided with a separator device 34, the web comprising the layers 32 and 35, which is formed downstream of the second headbox 31, would already be perfectly regular at its edges, and thus it would not be necessary to use the conventional device including the jets 37.

In accordance with the invention, it is not only possible to obtain perfect regularity of the edge of the resultant web whatever the number of layers which make up the web, but also the fibers of each of the layers, which normally are of different type or collected separately from the others with the advantage of being able to reuse them in the most suitable manner taking account of their physical and chemical characteristics.

It is intended to cover equivalent methods and structures within the spirit and scope of the invention.

I claim as my invention:

1. The method of controlling the edge of a paper web formed on a traveling foraminous wire from stock issuing from the slice of a headbox comprising the steps of:

separating the marginal edge of a layer of stock as it leaves the slice opening by placing a blade in contact with the slice in the stock flow from the slice opening;

collecting the material of said marginal edge by conveying it into a collector; and the blade being located in a predetermined position and being adjusted along the emerging width of the layer leaving the slice opening in accordance with the width of the edge to be removed.

2. A device for controlling the edge of a paper web formed on a traveling foraminous wire from stock issuing from a slice opening of a headbox comprising in combination with said headbox:

a thin blade in contact with the slice and positioned along the path traveled by the stock as it leaves a slice opening of a headbox with a blade extending parallel to the flow of stock and in a position to intersect the flow of stock and separate one edge from the layer of stock;

conveying means positioned adjacent the blade location receiving the material of the edge which is separated by the blade; and means for adjusting the blade relative to the slice opening while maintaining the blade in a predetermined cross-machine direction.

3. A device for controlling the edge of a paper web formed on a traveling foraminous wire of a papermaking machine from stock issuing from a slice opening of a headbox of said machine comprising in combination with said headbox:

a thin blade positioned along the path traveled by the stock as it leaves a slice opening of a headbox with a blade extending parallel to the flow of stock and in a position to intersect the flow of stock and separate one edge from the layer of stock;

conveying means positioned adjacent the blade location receiving the material of the edge which is separated by the blade; and the blade having a shape such that it is in contact with the front surface of the slice lip defining said slice opening.

4. A device for controlling the edge of a paper web formed on a traveling foraminous wire from stock issuing from a slice opening of a headbox comprising in combination with said headbox:

a blade means in contact with the slice and positioned to intersect the path of travel of the stock as it leaves the slice opening to be deposited on a traveling foraminous wire and separate an edge from the flow of stock;

means for subsequently removing the separated edge material; and means for adjusting the cross-machine direction of the blade to change the width of edge removed from the web to be formed on the wire.

5. The method of controlling the edge of a multi-ply paper web formed on a traveling foraminous wire from stock issuing from the slice openings of first and second headboxes comprising the steps:

depositing a first layer from the first headbox on the traveling wire;

depositing a second layer on top of the first layer from the second headbox; and positioning a blade adjacent the edge of the second layer at the exit of the slice opening of the second headbox before the second layer is deposited on the first layer to intersect the flow of stock and separate one edge from the layer of stack, thereby making the second layer narrow than said first layer and removing the stock separated by the blade so that the separated stock is maintained integral and separate from the stock of the first headbox for reuse.

6. The method of controlling the edge of a multi-ply paper web is accordance with the steps of claim 5:

including applying an edge separating jet to the first layer after the second layer has been deposited thereon at substantially the location of the edge of the second layer to complete the trimming of the multi-ply web.

7. A device for controlling the edge of a multi-ply paper web formed on a traveling foraminous wire of a papermaking machine from stock issuing from the slice openings of first and second headboxes of said machine comprising in combination with said second headbox:

a thin blade positioned at the exit from the slice opening of the second headbox adjacent the edge thereof for separating the edge of the flow of stock from the center portion so that the second layer is narrower than the first layer; and conveying means positioned adjacent the blade for receiving the separated edge so that the material is maintained separate from the first layer and the trimmed second layer is deposited on the first layer.

8. A device for controlling the edge of a multi-ply paper web formed on a traveling foraminous wire from stock issuing from first and second headboxes constructed in accordance with claim 7:

including a jet positioned downstream from the second headbox directed at the edge of the first layer substantially coincident with the edge of the second layer for trimming the first layer.

* * * * *